US006085805A

United States Patent [19]

Bates

[11] Patent Number: 6,085,805

[45] **Date of Patent: *Jul. 11, 2000**

[54] COMMUNICATIONS SYSTEM AND METHOD, FLEET MANAGEMENT SYSTEM AND METHOD, AND METHOD OF IMPEDING THEFT OF FUEL

[75] Inventor: Benjamin G. Bates, Boise, Id.

[73] Assignee: Micron Technology, Inc., Boise, Id.

[ * ] Notice: This patent is subject to a terminal disclaimer.

[21] Appl. No.: 09/443,174

[22] Filed: Nov. 19, 1999

Related U.S. Application Data

[63] Continuation of application No. 09/105,076, Jun. 25, 1998, Pat. No. 6,024,142.

[51] Int. Cl.[7] ..... B65B 1/04

[52] U.S. Cl. ..... 141/94; 141/192; 141/392; 343/892

[58] Field of Search ..... 141/94, 192, 83, 141/351, 392; 343/892; 222/71

[56] References Cited

U.S. PATENT DOCUMENTS

| | | | |
|---|---|---|---|
| 4,367,827 | 1/1983 | Keller et al. . | |
| 4,469,149 | 9/1984 | Walkey et al. . | |
| 4,490,798 | 12/1984 | Franks et al. . | |
| 4,881,581 | 11/1989 | Hollerback . | |
| 4,934,419 | 6/1990 | Lamont et al. . | |
| 5,156,198 | 10/1992 | Hall . | |
| 5,359,522 | 10/1994 | Ryan . | |
| 5,605,182 | 2/1997 | Oberrecht et al. . | |
| 5,628,351 | 5/1997 | Ramsey, Jr. et al. . | |
| 5,671,786 | 9/1997 | Corfitsen | 141/94 |
| 5,727,608 | 3/1998 | Nusbaumer et al. . | |
| 5,890,520 | 4/1999 | Johnson, Jr. | 141/94 |
| 5,906,228 | 5/1999 | Keller . | |
| 5,913,180 | 6/1999 | Ryan . | |

OTHER PUBLICATIONS

Roseman Engineering Ltd. Web Pages, Jun. 22, 1998.

*Primary Examiner*—Steven O. Douglas
*Attorney, Agent, or Firm*—Wells, St. John, Roberts, Gregory & Matkin, P.S.

[57] ABSTRACT

A communications system for communications between a vessel and a fluid management system, the communications system comprising a proximity detector supported by the vessel and configured to detect presence of a fuel nozzle in a fluid entry port of the vessel; and an RFID supported by the vessel, coupled to the proximity detector, and configured to communicate with a RFID interrogator to identify the vessel to the RFID interrogator, and to communicate whether the nozzle is in the fluid entry port. A method of impeding theft of fuel, the method comprising establishing a first communication link between a vehicle and a fuel delivery system; establishing a second communication link between the vehicle and the fuel delivery system; communicating using the second communication link, from the vehicle to the fuel management system, that the first communication link is established; delivering fuel from the fuel delivery system to the vehicle in response to the communicating; and suspending the delivering in response to a break in the first communication link.

46 Claims, 3 Drawing Sheets

COMMUNICATIONS SYSTEM AND METHOD, FLEET MANAGEMENT SYSTEM AND METHOD, AND METHOD OF IMPEDING THEFT OF FUEL

CROSS REFERENCE TO RELATED APPLICATION

This is a Continuation of U.S. patent application Ser. No. 09/105,076, now U.S. Pat. No. 6,024,142, filed Jun. 25, 1998, and titled "Communications System and Method, Fleet Management System and Method, and Method of Impeding Theft of Fuel".

TECHNICAL FIELD

The invention relates to controlling delivery of fluid, such as fuel, to vessels or vehicles. The invention also relates to fuel management systems such as those used with vehicle fleets.

BACKGROUND OF THE INVENTION

Commercial fleets represent a significant portion of the fuel market around the world. Various systems are known that allow fleet operators or managers to automatically monitor and control vehicle fuel usage, record odometer and engine hour readings, monitor efficiency, and simplify and speed the refueling process. For fleet management, amount of fuel used, distance traveled and diagnostic information is useful. Operators of fleets of vehicles sometimes use their own private fuel dispensing sites. For example, a city may have a large number of vehicles used by police departments, fire departments, sanitation departments, parks departments, etc., and may have their own refueling sites in one or more locations in the city for these vehicles. Alternatively, these vehicles may be refueled at commercial gas stations by the operator of the vehicle, though the city or fleet manager would pay for the fuel.

Some managed systems are manual systems in which data, such as odometer readings, pump number, and driver identification number are manually entered by an operator using a keypad. Such manual entry of data is voluntary and is subject to error.

A key aspect of these systems involves preventing fleet users from fueling unauthorized vehicles. Fuel is expensive, more so in some countries than others, and it is desirable to impede theft of fuel by fleet employees or drivers. Theft of fuel in various degrees by employees and nonemployees is common. With regard to maintenance, operators will sometimes not have a vehicle assigned exclusively to them and will lack the feeling of responsibility necessary for them to determine if routine preventative maintenance is required.

This problem doesn't exist if the driver is a retail consumer because, in a consumer setting, the driver of the vehicle is the person paying for the fuel. If the driver diverts fuel away from the vehicle to a container or another vehicle, he or she will still have to pay for it.

There are a variety of systems in the market today that offer fraud protection systems for fuel dispensation. Some systems use a card that has an identification number on a magnetic strip. To receive fuel, the card is inserted into or swiped through a reader. The information is communicated to a central processing unit, often off-site, which determines if the card is valid and which turns on the pump and records the transaction. A problem with this type of system is that such cards can be stolen. Another problem with this type of system is that the fuel can be dispensed into a container or vehicle other than the vehicle owned by the fleet. Cards may also be forged. Also, these systems do not detect whether routine maintenance should be performed.

Improved systems typically utilize a close coupling of a fuel inlet transponder and an antenna attached to the fuel nozzle. In order to communicate the information from the vehicle a wire must usually be run down the center of the fuel hose and connected to a reader device inside the pump. See, for example, U.S. Pat. No. 5,605,182 to Oberrecht et al. (incorporated herein by reference), which discloses a vehicle identification system for use in a refueling station. A circuit located on a nozzle spout generates an RF interrogation signal. The RF interrogation signal is detected by a transponder disposed on a vehicle adjacent the vehicle's fill pipe, when the nozzle is positioned adjacent to the vehicle's fill pipe. The RF interrogation signal energizes the transponder on the vehicle to transmit a return signal containing vehicle identification codes. These codes identify vehicle requirements, such as fuel type. The circuit on the nozzle spout interprets the vehicle identification codes and generates signals to control the dispenser in accordance with the vehicle requirements. Information is transmitted to nozzle via a cable which extends through the interior of the fuel hose.

U.S. Pat. No. 4,934,419 to Lamont et al. (incorporated by reference) discloses one end of a fiber optic cable being carried by a pump nozzle for receiving information (vehicle identification, distance information, and diagnostic information) from a transmitter on a commercial vehicle when the pump nozzle is inserted into the fuel entry port of that vehicle. The fiber optic cable is run from the top of the nozzle, through a special fitting into the interior of the hose, then runs the length of the delivery hose, surrounded by fuel product, until it reaches the region of the fuel pump and emerges and runs on to a fuel management system.

In addition to transmitting information, these cables carried by the fuel pump hose are sometimes used to transmit information to a controller which suspends delivery of fuel if it is determined that a break in communication with the vehicle occurred, indicating a diversion of fuel to another container or vehicle (e.g., an attempted theft of fuel).

U.S. Pat. No. 4,469,149 to Walkey et al. (incorporated herein by reference) discloses a fuel pump nozzle which carries an optical bar code reader to reading an optical bar code in a vehicle fuel reservoir entry port. The reader is provided with output signal leads extending along the outside of the nozzle and along the flexible hose back to the fuel pump and to a control unit. A comparator compares data from the reader with data from a data source to determine whether that vehicle is authorized to receive fuel.

U.S. Pat. No. 5,737,608 to Nusbaumer et al. (incorporated herein by reference) discloses an automated fuel management system including a fuel dispensing nozzle having a receiving antenna. A fuel receiving tank has a transmitting antenna. The transmitting antenna transmits a radio frequency signal having encoded information about the vehicle. The receiving antenna and transmitting antenna are in such close proximity as to interrupt transmission of the information and to cause cessation of the fueling operation upon minimal withdrawal of the fueling nozzle from the fuel tank.

Attention is also directed to fuel management system sold by Roseman Engineering Ltd., 65 Weizman St., Givatayim 53468 Israel. Prior art systems sold by Roseman Engineering Ltd. require a cable from a low frequency nozzle communication coil along a fuel pump hose for transmission of data from the nozzle RFID along the cable. The nozzle communication coil reads data from the vehicle via an associated vehicle communication coil, and transmits it through the cable along the fuel pump hose.

These types of systems may be fine for private fuel depots, but they do not work very well in the retail fuel stations. Private stations are costly and demand administrative and human resources to maintain. Another problem stems from the fact that the hoses and nozzles are the highest maintenance items in a fuel station. Drivers sometimes drive off with hoses, which detach from the fuel pump. Maintenance of these systems can be quite costly since they require specially trained personnel.

Thus, there is a need for a system that can provide both a high volume, reliable retail solution while at the same time providing a robust fleet capability.

SUMMARY OF THE INVENTION

The invention provides a communications system for communications between a vessel, such as a vehicle, and a fluid management system, such as a fuel management system. The vessel has a fluid entry port. The fluid management system includes a fluid pump, a fluid dispenser conduit including a nozzle in fluid communication with the fluid pump, and an RFID interrogator in communication with the fluid pump. The RFID interrogator controls operation of the fluid pump. The fluid management system further includes an antenna coupled to the RFID interrogator and supported proximate the fluid pump. The communications system comprises a proximity detector supported by the vessel and configured to detect presence of the nozzle in the fluid entry port. The communications system further comprises an RFID supported by the vessel, coupled to the proximity detector, and configured to communicate with the RFID interrogator to identify the vessel to the RFID interrogator, and to communicate whether the nozzle is in the fluid entry port.

In one aspect of the invention, the communications system further comprises an identification device supported by the nozzle, and the proximity detector is configured to read the identification device to determine whether the nozzle is in the fluid entry port.

Another aspect of the invention provides a fleet management system for use with a vehicle of a fleet of vehicles. The vehicle has a fuel entry port. The system comprises a fuel management system including a fuel pump, and a flexible hose. The flexible hose has a first end in fluid communication with the fuel pump and has a second end. The fuel management system includes a nozzle in fluid communication with the second end, and an RFID interrogator in communication with the fuel pump and controlling operation of the fuel pump. The fuel management system further includes an antenna coupled to the RFID interrogator and supported proximate the fuel pump. The fleet management system further includes a nozzle RFID supported by the nozzle, and a fuel entry port antenna configured to be supported by the vehicle proximate the fuel entry port. The fleet management system further includes a vehicle module configured to be supported by the vehicle, and coupled to the fuel entry port antenna, the vehicle module being configured to read identification information from the nozzle RFID. The fleet management system further includes a vehicle RFID configured to be in serial communication with the vehicle module, the vehicle RFID being configured to communicate with the fuel pump RFID interrogator to identify the vehicle to the fuel pump interrogator, and to communicate whether the nozzle RFID device is in proximity with the fuel entry port antenna.

Another aspect of the invention provides a method of impeding theft of fuel. The method comprises establishing a first communication link is established between a vehicle and a fuel delivery system. A second communication link is established between the vehicle and the fuel delivery system. Using the second communication link, it is communicated from the vehicle to the fuel management system, that the first communication link is established. Fuel is delivered from the fuel delivery system to the vehicle in response to the communicating. The delivering is suspended in response to a break in the first communication link.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
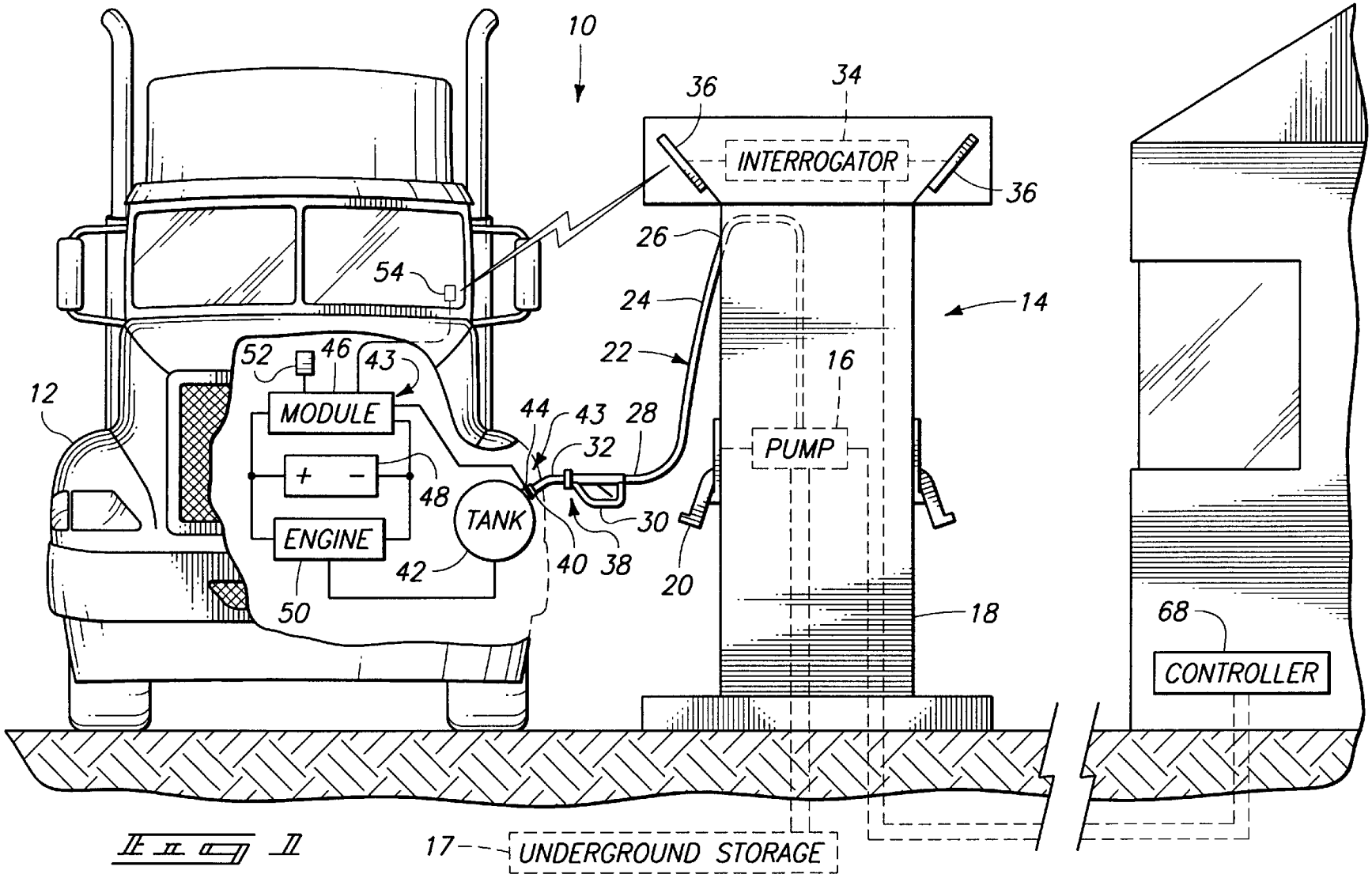
FIG. 1 is a front elevational view, partly in block diagram form, illustrating a system embodying the invention.

FIG. 1 shows a system 10 embodying the invention. The invention has application to delivery systems for delivering fluids of any sort to a vessel of any sort (a boat, an aircraft, an underground or above ground storage tank, or any kind of container); however, in the illustrated embodiment, the system is a fleet management system for managing delivery of fuel (e.g., gasoline, diesel, propane, natural gas, etc.) to vehicles 12, such as trucks, cars, or vans, of a fleet of vehicles. In one embodiment, one or more of the vehicles 12 of the fleet run on the fuel delivered to them. In another embodiment, one or more of the vehicles merely transport the fuel (e.g., the vehicles are tanker vehicles).

The fleet management system 10 includes a fuel management system 14. The fuel management system 14 includes a fuel pump 16 in a typical dispenser housing 18 having typical controls 20 for switching the pump 16 on and off. The fuel pump 16 pumps fuel, in operation, from a fuel tank, such as an underground storage tank 17. The fuel management system 14 further includes a fuel dispenser conduit 22 in fluid communication with the fuel pump 16. The fuel dispenser conduit 22 includes a flexible hose 24 having an end 26 in fluid communication with the fuel pump and having an end 28. The fuel dispenser conduit 22 further includes a trigger assembly 30 including a nozzle 32 in fluid communication with the end 28 of the hose 24.

The fuel management system 14 further includes a wireless interrogator 34 in communication with the fuel pump 16. In the illustrated embodiment, the interrogator 34 is a RF (radio frequency) interrogator for communicating with an RFID device (described below). The term "RFID," as used herein and in the appended claims, is to be construed as any device capable of communicating by radio frequency. For example, the term RFID should be construed as encompassing devices that transmit or receive any data by radio frequency, not just identification data. The fuel management system 14 further includes a controller 68 and controlling operation of the fuel pump 16 so as to at least be able to turn the pump 16 on and off. The controller 68 is in communication with the interrogator 34 and turns the pump 16 on and off partly in response to communications from the interrogator 34, as will be described below. In one embodiment, the interrogator 34 employed is identical to or similar to a model 4001 or 4120 interrogator available from Micron Communications, Inc., 3176 S. Denver Way, Boise, Id. The interrogator 34 can be similar to or identical to the interrogator disclosed in commonly assigned U.S. patent application Ser. No. 09/066,501 filed Apr. 23, 1998, or disclosed in U.S. patent application Ser. No. 09/080,624 filed May 18, 1998 (both of which are incorporated herein by reference).

The fuel management system 14 further includes an array of antennas 36 coupled to the RFID interrogator 34 and supported proximate the fuel pump 16.

The vehicles 12 have respective fuel entry ports or fuel inlets 40 leading to respective fuel tanks or reservoirs 42. The communications system 10 further includes, for respective vehicles, a proximity detector 43 supported by the vehicle 12 and configured to detect presence of the nozzle 32 in the fluid entry port 40. In the illustrated embodiment, the proximity detector comprises an entry port antenna 44 (see also FIG. 3), designed to be supported by the vehicle proximate the fuel entry port 40. In one embodiment, the antenna 44 is a T-ring antenna, model RVC-01-80, available from Roseman Engineering Ltd., 65 Weizman St., Givatayim 53468 Israel.

Figure 3:
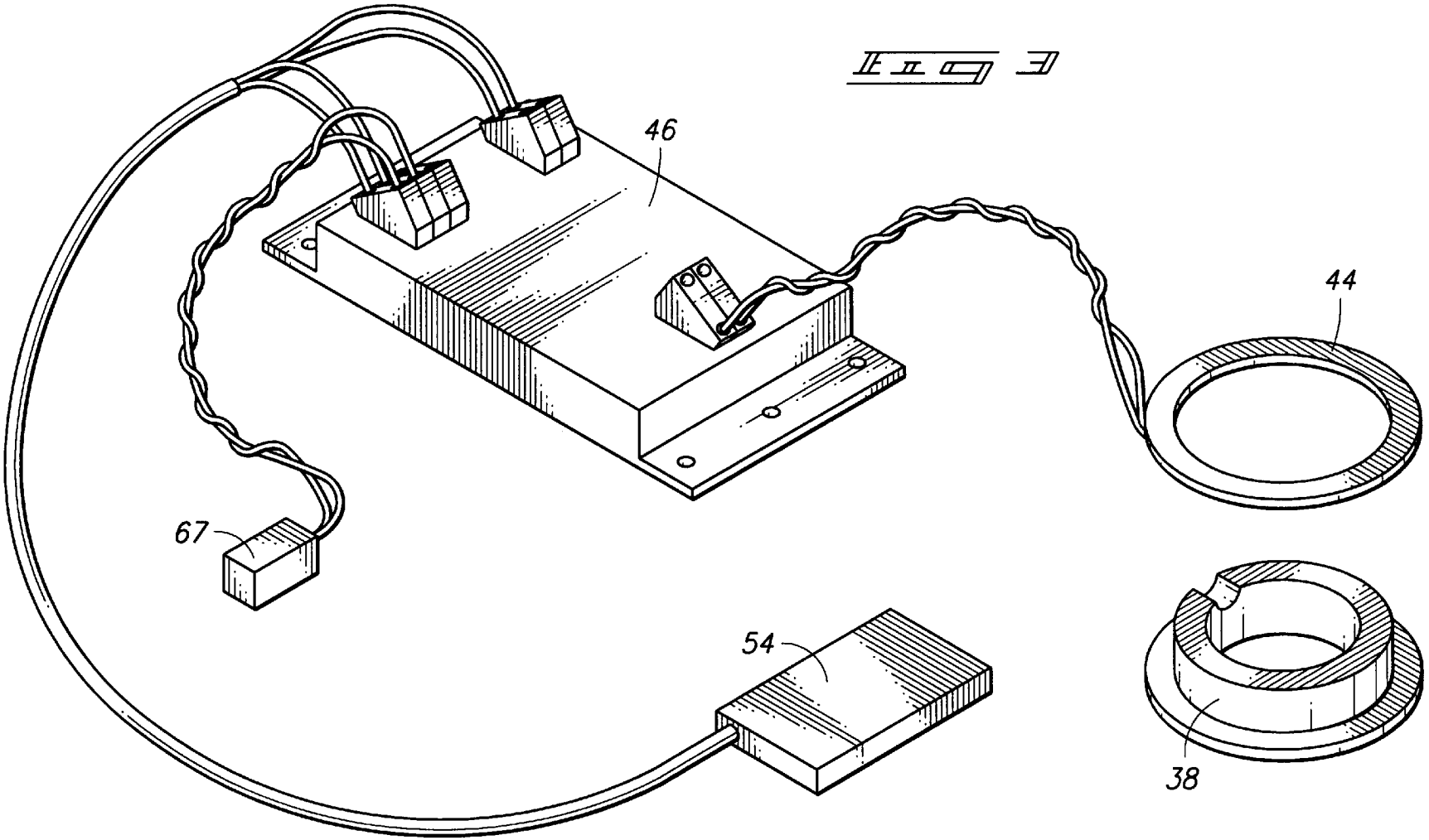
FIG. 3 is a perspective view showing the physical appearance of communication system components supported by the vehicle.

The fleet management system further includes a nozzle transponder 38 supported by the nozzle 32 (see also FIG. 3). In the illustrated embodiment, the nozzle transponder 38 is annular, slides onto the nozzle, and has a housing made of a material such as rubber which frictionally engages an outer surface of the nozzle 32 so as to permit a retrofit of a pre-existing fueling station, or is formed integrally with the trigger assembly 30. In the illustrated embodiment, the nozzle transponder 38 is an RFID device. In one embodiment, the nozzle transponder 38 is annular and of a size wherein it can be located radially between the nozzle and a sheath (not shown) for a vapor recovery system (or surrounds or is formed integrally with such a vapor recovery sheath). In an alternative embodiment, the nozzle transponder 38 is mounted to or supported by the trigger assembly 30 at a location other than the nozzle, or is mounted to or supported by the hose 24 proximate the end 28 so as to be useful in detecting proximity of the nozzle relative to the vehicle. In one embodiment, the RFID 38 is arranged on the conduit 22 so as to be within a predetermined distance away from the fuel entry port antenna 36 when the nozzle 32 is in the fuel entry port 40 for dispensation of fuel. The predetermined distance corresponds to the communication range between the fuel entry port antenna 36 and the nozzle transponder 38.

The nozzle transponder 38 stores an identification code with can be read by an interrogator (described below). In one embodiment, the nozzle transponder 38 is a passive RFID. In other words, the nozzle transponder 38 receives its power from magnetic coupling from another device. In one embodiment, the nozzle transponder 38 is similar to the one shown and described in U.S. Pat. No. 4,398,172 to Carroll et al. (incorporated herein by reference). In an alternative embodiment, the nozzle transponder 38 is an active RFID, having its own power source, such as batteries.

In operation, the antenna 44 is magnetically coupled to the nozzle transponder 38 for communication.

In an alternative embodiment, other systems for detecting the presence or absence of the nozzle 32 in the fuel entry port 40 can be employed, such as the system of U.S. Pat. No. 4,469,149 to Walkey et al., or the system of U.S. Pat. No. 5,737,608 to Nusbaumer et al., for example. Further, instead of using RF communications to determine if the nozzle 32 is in the fuel entry port 40, other means of communication could be employed. For example, an infrared link can be employed.

The respective vehicles are fitted with a vehicle module 46 (see also FIG. 3). The vehicle module 46 is supported by the vehicle in any convenient location. In the illustrated embodiment, the proximity detector 43 includes the vehicle module 46. In the illustrated embodiment, the vehicle module 46 is identical or similar to a model RID-04-44 (including a speedometer input) or model RID-04-45 (including a speedometer input and an engine hours input), available from Roseman Engineering Ltd., 65 Weizman St., Givatayim 53468 Israel.

In another embodiment (not shown), the vehicle module 46 is a model RID-04-46 (including a speedometer input and an engine hours input and further including a driver tag reader and optional immobilizer). In the illustrated embodiment, the nozzle transponder 38 is capable of being read, via the antenna 44, by a Roseman Engineering vehicle module model RID-04-44, RID-04-45, or RID-04-46.

The vehicle 12 has a battery 48 which is charged by a vehicle alternator (not shown), and an engine 50 which drives the alternator, and which, in the illustrated embodiment, runs using fuel from the tank 42. The battery 48 is used for supplying power to various electrical components of the vehicle 12. The vehicle module 46 is removably coupled to the vehicle's battery 48 to receive DC power from the vehicle battery 48. The vehicle module 46 is also removably coupled to the fuel entry port antenna 40.

The vehicle module 46 includes interrogator circuitry configured to interact, via the fuel entry port antenna 44, with the nozzle RFID 38 to determine presence of the nozzle 38 in the fuel entry port 40 and, in one embodiment, to further determine an identification code or other information from the RFID 38, such as a pump number and a nozzle number. The vehicle module 46, in operation, reads identification information from the RFID 38 via the fuel entry port antenna. More particularly, the fuel entry port antenna 44 establishes magnetic links with the RFID 38 to supply power to the RFID 38 and to read information from the RFID 38.

The respective vehicles 12 further include an odometer sensor 52 configured to provide a signal indicative of distance that has been traveled by the vehicle. If the vehicle does not have a digital odometer (e.g., the vehicle is an older vehicle), the odometer sensor 52 can be a pulse generator coupled to a speedometer cable included in the vehicle 12. For example, the odometer sensor 52 can be a speedometer adapter model ROT-02-51 (22 mm thread) or a model ROD-02-52 (18 mm thread), available from Roseman Engineering Ltd., 65 Weizman St., Givatayim 53468 Israel, fitted to a speedometer cable of the vehicle. The odometer sensor 52 could also be an encoder operating on a shaft or axle of the vehicle.

Alternatively, if the vehicle has a digital odometer (e.g., the vehicle is a newer vehicle), the odometer sensor 52 can be a part of an existing engine controller included in the vehicle. In this embodiment, the vehicle module 46 is coupled directly to the pre-existing engine controller or to a diagnostic data bus for single direction or bi-directional communication.

Figure 2:
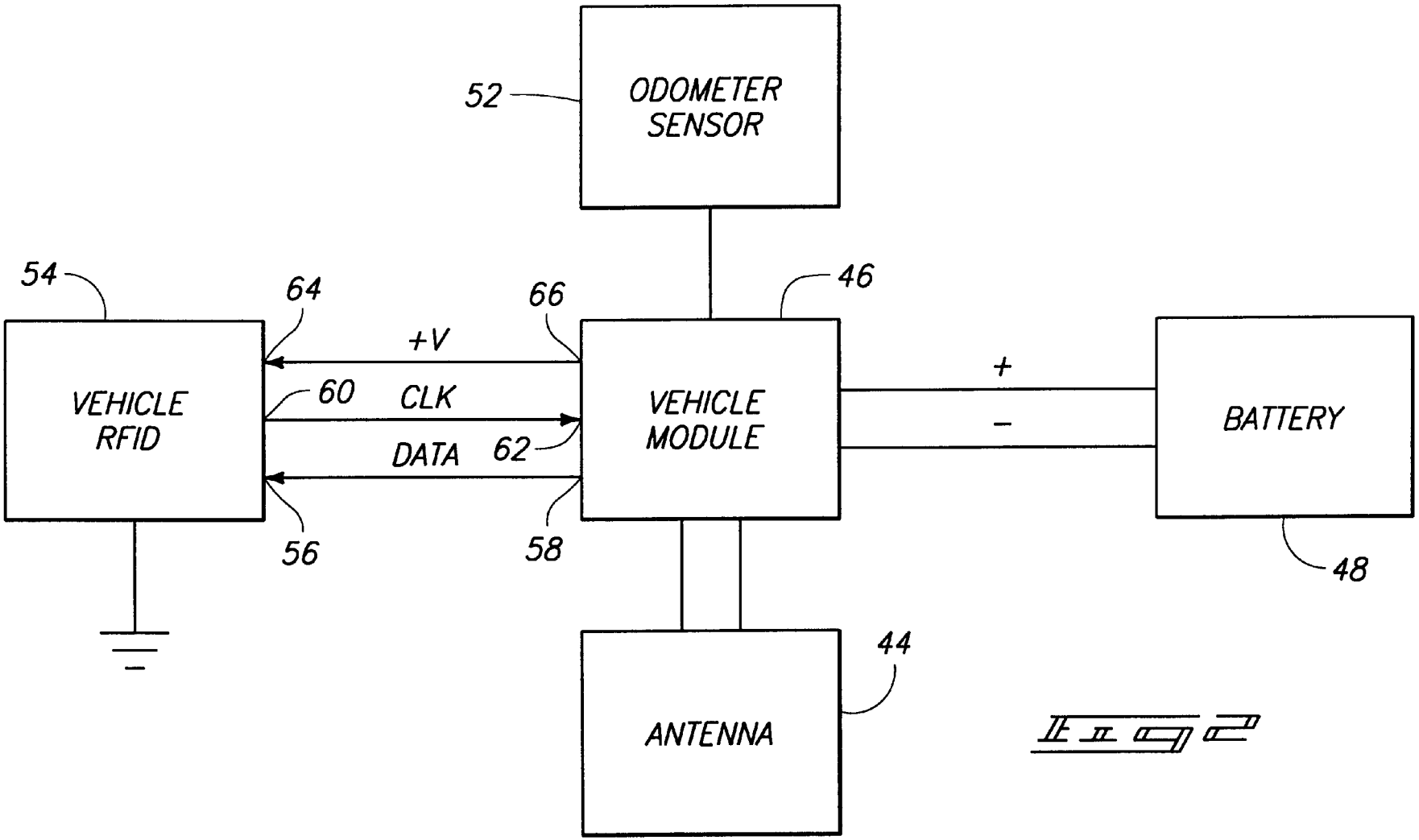
FIG. 2 is a block diagram illustrated circuitry included in a vehicle.

The respective vehicles are further fitted with a wireless communications device 54 coupled with the vehicle module 46 (FIGS. 2 and 3). In the illustrated embodiment, the wireless communicatons device 54 is in hard wired, digital, serial communication with the vehicle module 46; however, in an alternative embodiment, there is a wireless communication link intermediate the vehicle module and the wireless communications device 54. In the illustrated embodiment, the wireless communications device 54 is a device such as the MicroStamp 10ML remote intelligent communication device (RIC) available from Micron Communications, Inc., Boise Id. In one embodiment, the device 54 is a wireless communications device or RFID such as the device disclosed in U.S. patent application Ser. No. 08/705,043, filed Aug. 29, 1996 and incorporated herein by reference. The RFID 54 includes a digital data pin or input 56, and the vehicle module 46 has a digital output 58 coupled to the digital input 56 for communication of data from the vehicle module 46 to the vehicle RFID 54 (FIG. 2). The vehicle RFID 54 has a clock output 60 for controlling timing of data transmission, and the vehicle module 46 has a clock input 62 coupled to the clock output 60. The vehicle RFID 54 also has a power input 64, and the vehicle module 46 has a power output 66 coupled to the power input 64. The vehicle module 46 has a connector 67 (FIG. 3) coupled, either directly or via a transformer, to the battery 48.

Thus, the vehicle RFID 54 receives power from the vehicle battery 48, in the embodiment of FIG. 2, instead of being housed with a thin profile battery. The vehicle RFID 54 can be coupled to ground (vehicle frame) to complete a circuit path, or a conductor can extend back to the vehicle module. In the illustrated embodiment, the vehicle RFID 54 is coupled to the vehicle module 46 with a quick-disconnect connector. In addition to transmitting odometer information and engine hour information, the RFID 54 can transmit diagnostic information to the interrogator 34 for use by the controller 68 in diagnosing problems with the engine 50. Further, the RFID 54 can receive information from the interrogator 34 and communicate the information, if appropriate, to the engine controller. For example, the interrogator 34 can transmit software upgrades to the vehicle via the RFID 54. The interrogator 34 could also send license information to the vehicle; e.g., to authorize use of a game, or viewing of a movie already installed in the vehicle 12. Other information can be passed from the vehicle 12 to the interrogator 34 or from the interrogator 34 to the vehicle 12 via the RFID 54.

FIG. 2 also shows the odometer sensor 52, the battery 48, and the antenna 44 coupled to the vehicle module 46.

The vehicle RFID 54, in operation, communicates with the fuel pump RFID interrogator 34 to identify the vehicle 12 by transmitting a vehicle identification code (and/or an account number) to the fuel pump interrogator 34. In an alternative embodiment, the vehicle RFID 54 communicates, in operation, an account number, or both an account number and a vehicle identification code. The vehicle RFID 54 further communicates, in operation, whether the RFID 38 is in proximity with the fuel entry port antenna 40, communicates the nozzle identification code and pump number of the nozzle RFID 38, and communicates the distance information from the odometer sensor 52. In one embodiment, the vehicle module 46 further reads engine hours of the vehicle 12, and the vehicle RFID 54 communicates engine hours to the fuel pump RFID interrogator 34. The communication of the identification code, proximity information, distance information, and engine hours can occur in any order or any desired manner; however, the communication occurs while the vehicle is near the fuel pump; e.g., during a single refueling.

The controller 68 is coupled to multiple pumps 16 and interrogators 34 and determines whether to authorize fueling at respective pumps 16. For example, upon receiving vehicle account number or identification information from an interrogator 34, the controller 68 checks financial records, determines whether the owner of the account number has a positive balance or has sufficient credit, and authorizes fueling. If the proximity detector 43 determines that the nozzle 32 is in the fuel entry port 40, fuel delivery begins automatically. As far as the driver of the vehicle is concerned, he or she simply inserts the fuel nozzle 32 into the fuel entry port 40 and fueling begins shortly thereafter. There is no need for keypads, credit cards, checks, keys or cash. After fueling is complete, the controller 68 deducts the cost of the fuel that was pumped from the account associated with the account number or identification information.

If the proximity detector 43 determines that the nozzle 32 has been removed from the fuel entry port 40 after the controller 68 has authorized fuel delivery, fuel delivery is suspended. More particularly, the fuel management system 14 suspends fueling by shutting off the fuel pump 16 if the vehicle RFID 54 communicates to the fuel pump RFID interrogator 34 that the nozzle RFID device 38 is not in proximity with the fuel entry port antenna 44. Thus, if a driver or other employee attempts to divert fuel from the vehicle to another vehicle or container during fueling, pumping of fuel will be suspended and any other action deemed appropriate may be taken (e.g., a record of the occurrence may be made for notification to the owner of the account). Controllers are available from Roseman Engineering Ltd., 65 Weizman St., Givatayim 53468 Israel.

In one embodiment, the fuel management system 14 is used with both commercial vehicles and with consumers. In this embodiment, the system 14 determines, by reading a code on a vehicle RFID 54, whether the vehicle is a commercial vehicle, or a consumer vehicle. If it is a consumer vehicle (or commercial vehicle for which an account owner decides not to enable the proximity detection feature), proximity between an entry port antenna 44 and a nozzle RFID 38 is not required for fueling. Such vehicles do not require a fuel entry port antenna 44. Fueling is authorized by the controller 68 as soon as the vehicle RFID 54 is read after account information is checked and the controller 68 determines that dispensation of fuel can be authorized for this vehicle.

If a vehicle does not have a vehicle RFID 54, it can still receive fuel from the fuel management system 14, but automated initiation of fueling is not available. Instead, the operator must pay in the conventional way. The pump housing 18 may also support a credit card or debit card reader for authorizing fueling in the conventional way.

In an embodiment where the system 14 will be used with both commercial vehicles and consumer vehicles, the vehicle RFID 54 can be mounted on the rear window or on the side window nearest the fuel entry port, on the fueling side of the vehicle, inside the vehicle. Non-commercial vehicles can support a RFID 54 from a keychain or elsewhere because, in one embodiment, their RFID will not be coupled to a vehicle module. In one embodiment, the array of antennas 36 has a communications sweet spot in the passenger area near the fuel entry port. In an embodiment where the system 14 will solely be used with commercial vehicles, there is more flexibility in where the vehicle RFID can be located. For example, it can be located exterior of the vehicle, supported by a bumper, or any other location, though preferably on or close to the side of the vehicle that faces the fuel pump during fueling.

In the illustrated embodiment, the fuel pump 16, interrogator 34, nozzle 32, etc. are stationary; however, in an alternative embodiment, they are mobile, such as on a tanker that dispenses fuel or some other fluid to gas stations or various destinations. For example, a tanker may deliver home heating fuel to various homes. In this embodiment, the homes would have a tank 42, interrogator circuitry 34 for communicating with a nozzle RFID 32 of the tanker, and a second RFID 54 in digital serial communication with the interrogator circuitry for communicating with an interrogator on the tanker. Of course, odometer and engine hour information would not be transmitted.

Thus, a system has been provided wherein, because of two communication links, no cable is required to be run along a hose from the nozzle RFID device to the fuel management system. The system impedes theft of fuel by operators who are not necessarily owners of vehicles. Nonetheless, the operator of the vehicle sees an advantage in that fueling begins automatically without need for cash, cards, keys, or keying of codes in a keypad. Maintenance can be advised or scheduled based on odometer or engine hours information.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A communications system for communications between a vessel and a fluid management system, the vessel having a fluid entry port, the fluid management system including a fluid pump, a fluid dispenser conduit including a nozzle in fluid communication with the fluid pump, a wireless interrogator in communication with the fluid pump to control the fluid pump, the communications system comprising:

a proximity detector configured to be supported by the vessel and configured to detect presence of the nozzle in the fluid entry port; and a wireless communications device configured to be supported by the vessel, coupled to but spaced apart from the proximity detector, and configured to communicate with the interrogator to identify the vessel to the interrogator, and to communicate whether the nozzle is in the fluid entry port.

2. A communications system in accordance with claim 1 and further comprising an identification device supported by the nozzle, wherein the proximity detector is configured to read the identification device to determine whether the nozzle is in the fluid entry port.

3. A communications system for communications between a vehicle and a fluid management system, the vehicle having a fluid entry port, the fluid management system including a fluid pump, a fluid dispenser conduit including a nozzle in fluid communication with the fluid pump, a wireless interrogator in communication with the fluid pump and controlling operation of the fluid pump, and an antenna coupled to the interrogator and supported proximate the fluid pump, the communications system comprising:

a proximity detector supported by the vehicle and configured to detect presence of the nozzle in the fluid entry port; and a wireless communications device supported by the vehicle, electrically connected to but spaced apart from the proximity detector, the wireless communications device being configured to communicate with the interrogator to identify the vehicle to the interrogator, and to communicate whether the nozzle is in the fluid entry port.

4. A communications system in accordance with claim 3 and further comprising an identification device supported by the nozzle, and wherein the proximity detector comprises interrogator circuitry supported by the vehicle and configured to interact with the identification device to determine presence of the nozzle in the fluid entry port.

5. A communications system in accordance with claim 3 and further comprising an identification device supported by the nozzle, wherein the identification device is configured to communicate an identification code, and wherein the proximity detector is configured to interact with the identification device to determine the identification code and to determine presence of the nozzle in the fluid entry port.

6. A communications system in accordance with claim 5 wherein the wireless communications device is configured to communicate the identification code to the interrogator.

7. A communications system for communications between a vehicle of a fleet of vehicles and a fuel management system, the vehicle having a fuel entry port, the fuel management system including a fuel pump, a fuel dispenser conduit in fluid communication with the fuel pump, an RFID interrogator in communication with the fuel pump and controlling operation of the fuel pump, and an antenna coupled to the RFID interrogator and supported proximate the fuel pump, the communications system comprising:

a fuel dispenser conduit RFID configured to be supported by the fuel dispenser conduit;

a fuel entry port antenna configured to be supported by the vehicle proximate the fuel entry port;

a vehicle module configured to be supported by the vehicle, coupled to the fuel entry port antenna, the vehicle module being configured to read identification information from the fuel dispenser conduit RFID, using the fuel entry port antenna; and a vehicle RFID configured to be supported by the vehicle and in communication with the vehicle module, the vehicle RFID being configured to communicate with the fuel pump RFID interrogator to identify the vehicle to the fuel pump interrogator, and to communicate that the fuel dispenser conduit RFID device is in proximity with the fuel entry port antenna.

8. A communications system in accordance with claim 7 wherein the fuel dispenser conduit RFID is a passive RFID.

9. A communications system in accordance with claim 7 wherein the fuel dispenser conduit RFID is configured to receive power through magnetic coupling with the fuel entry port antenna.

10. A communications system in accordance with claim 7 wherein the vehicle RFID is further configured to store a vehicle identification number.

11. A communications system in accordance with claim 7 wherein the vehicle RFID is further configured to transmit a vehicle identification number to the RFID interrogator.

12. A communications system in accordance with claim 7 wherein the vehicle RFID is further configured to transmit an account number associated with the vehicle.

13. A fleet management system in accordance with claim 7 and further comprising an odometer sensor configured to be supported by the vehicle and configured to provide a signal indicative of distance traveled by the vehicle, and wherein the vehicle RFID is configured to communicate the distance information to the fuel pump RFID interrogator.

14. A fleet management system for use with a vehicle of a fleet of vehicles, the vehicle having a fuel entry port, the system comprising:

a fuel management system including a fuel pump, a flexible hose having a first end in fluid communication with the fuel pump and having a second end, a nozzle in fluid communication with the second end, an RFID interrogator in communication with the fuel pump and controlling operation of the fuel pump;

a nozzle RFID supported by the nozzle;

a fuel entry port antenna configured to be supported by the vehicle proximate the fuel entry port;

a vehicle module configured to be supported by the vehicle, and coupled to the fuel entry port antenna, the vehicle module being configured to read identification information from the nozzle RFID; and a vehicle RFID in serial communication with the vehicle module, the vehicle RFID being configured to communicate with the fuel pump RFID interrogator to identify the vehicle to the fuel pump interrogator, and to communicate whether the nozzle RFID device is in proximity with the fuel entry port antenna.

15. A fleet management system in accordance with claim 14 wherein the fuel management system is configured to shut off the fuel pump if the vehicle RFID communicates to the fuel pump RFID interrogator that the nozzle RFID device is not in proximity with the fuel entry port antenna.

16. A fleet management system in accordance with claim 14 wherein the vehicle RFID is in digital communication with the vehicle module.

17. A fleet management system in accordance with claim 14 wherein the vehicle RFID is in digital, hard wired, communication with the vehicle module.

18. A fleet management system in accordance with claim 14 wherein the vehicle RFID is in serial communication with the vehicle module.

19. A fleet management system in accordance with claim 14 wherein the vehicle RFID is in serial, hard wired, communication with the vehicle module.

20. A fleet management system in accordance with claim 14 and further comprising an odometer sensor configured to be supported by the vehicle and configured to provide a signal indicative of distance traveled by the vehicle, and wherein the vehicle RFID is configured to communicate the distance information to the fuel pump RFID interrogator.

21. A communications system for communications between a vessel and a fluid management system, the vessel having a fluid entry port, the fluid management system including a fluid pump, a fluid dispenser conduit in fluid communication with the fluid pump, an RFID interrogator in communication with the fluid pump and controlling operation of the fluid pump, the communications system comprising:

a fluid dispenser conduit RFID adapted to be supported by the fluid dispenser conduit;

a fluid entry port antenna configured to be supported by a vessel proximate the fluid entry port;

circuitry configured to be supported by the vessel, coupled to but spaced apart from the fluid entry port antenna, to determine if the fluid dispenser conduit RFID device is in proximity with the entry port antenna; and a vessel RFID configured to be coupled to the circuitry, the vessel RFID being configured to communicate with the fluid pump RFID interrogator to identify the vessel to the fluid pump interrogator, and to communicate if the fluid dispenser conduit RFID device is in proximity with the fluid entry port antenna.

22. A communications system in accordance with claim 21 wherein the vessel RFID is hard wired to the circuitry.

23. A communications system in accordance with claim 21 wherein the vessel RFID is in digital communication with the circuitry.

24. A communications system in accordance with claim 21 wherein the circuitry is configured to read identification information from the fluid dispenser conduit RFID.

25. A communications system in accordance with claim 21 wherein the circuitry is configured to read identification information from the fluid dispenser conduit RFID, and wherein the vessel RFID communicates the identification information from the fluid dispenser conduit RFID to the fluid pump RFID interrogator.

26. A method comprising:

supporting a RFID from a nozzle of a fuel dispenser;

supporting a fuel entry port antenna from a vehicle, proximate a fuel entry port of the vehicle;

establishing a first communication link between a vehicle and a fuel delivery system using the RFID and fuel entry port antenna;

communicating from the vehicle to the fuel management system that the first communication link is established;

delivering fuel from the fuel delivery system to the vehicle in response to the communicating; and suspending the delivering in response to a break in the first communication link.

27. A method in accordance with claim 26 wherein establishing the first communication link requires proximity between a fuel delivery nozzle of the fuel delivery system and a fuel entry port of the vehicle.

28. A method in accordance with claim 26 wherein establishing the first communication link comprises establishing passive RFID communications.

29. A method in accordance with claim 28 and further comprising, from the vehicle, reading an identification code from the RFID.

30. A method in accordance with claim 29 and further comprising transmitting the identification code from the vehicle to the fuel management system with the second communication link.

31. A method of communication between a vehicle of a fleet of vehicles and a fuel management system, the vehicle having a fuel entry port, the fuel management system including a fuel pump, a fuel dispenser conduit in fluid communication with the fuel pump, an RFID interrogator in communication with the fuel pump and controlling operation of the fuel pump, and an antenna coupled to the RFID interrogator and supported proximate the fuel pump, the communications method comprising:

supporting a fuel dispenser conduit RFID from the fuel dispenser conduit;

supporting a fuel entry port antenna from the vehicle, proximate the fuel entry port;

coupling a vehicle module to the fuel entry port antenna;

reading identification information from the fuel dispenser conduit RFID;

coupling a vehicle RFID to the vehicle module; and communicating from the vehicle RFID to the fuel pump RFID interrogator to identify the vehicle to the fuel pump interrogator, to communicate whether the fuel dispenser conduit RFID device is in proximity with the fuel entry port antenna.

32. A communications method in accordance with claim 31 and further comprising receiving, with the fuel dispenser conduit RFID, power through magnetic coupling with the fuel entry port antenna.

33. A communications method in accordance with claim 31 and further comprising storing in the vehicle RFID a vehicle identification number.

34. A communications method in accordance with claim 31 and further comprising transmitting, with the vehicle RFID, a vehicle identification number to the RFID interrogator.

35. A method in accordance with claim 31 and further comprising supporting an odometer sensor from the vehicle coupling the odometer sensor to the vehicle RFID, and communicating, from the vehicle RFID to the fuel pump RFID interrogator, information from the odometer sensor.

36. A communications method in accordance with claim 31 and further comprising transmitting, with the vehicle RFID, hours of use of the engine of the vehicle since the last fueling.

37. A fleet management method for use with a vehicle of a fleet of vehicles, the vehicle having a fuel entry port, the method comprising:

providing a fuel management system including a fuel pump, a flexible hose having a first end in fluid communication with the fuel pump and having a second end, a nozzle in fluid communication with the second end, an RFID interrogator in communication with the fuel pump and controlling operation of the fuel pump;

supporting a nozzle RFID from the nozzle;

supporting a fuel entry port antenna from the vehicle proximate the fuel entry port;

supporting a vehicle module from the vehicle, coupling the vehicle module to the fuel entry port antenna, the vehicle module being configured to read identification information from the nozzle RFID; and coupling in serial communication a vehicle RFID with the vehicle module, and communicating from the vehicle RFID to the fuel pump RFID interrogator to identify the vehicle to the fuel pump interrogator, and to communicate that the nozzle RFID device is in proximity with the fuel entry port antenna.

38. A fleet management method in accordance with claim 37 and further comprising shutting off the fuel pump if the vehicle RFID communicates to the fuel pump RFID interrogator that the nozzle RFID device is no longer in proximity with the fuel entry port antenna.

39. A fleet management method in accordance with claim 37 and further comprising supporting an odometer sensor from the vehicle, coupling the odometer sensor to the vehicle RFID, and communicating, from the vehicle RFID to the fuel pump RFID interrogator, information from the odometer sensor.

40. A communications method for communications between a vessel and a fluid management system, the vessel having a fluid entry port, the fluid management system including a fluid pump, a fluid dispenser conduit in fluid communication with the fluid pump, an RFID interrogator in communication with the fluid pump and controlling operation of the fluid pump, the communications method comprising:

supporting a fluid dispenser conduit RFID from the fluid dispenser conduit;

supporting a fluid entry port antenna from the vessel proximate the fluid entry port;

supporting circuitry from the vessel and coupling the circuitry to the fluid entry port antenna;

coupling a vessel RFID to the circuitry; and communicating from the vessel RFID to the fluid pump RFID interrogator to identify the vessel to the fluid pump interrogator, and to indicate whether the fluid dispenser conduit RFID device is in proximity with the fluid entry port antenna.

41. A communications method in accordance with claim 40 and further comprising hard wiring the vessel RFID to the circuitry.

42. A communications method in accordance with claim 40 and further comprising coupling the vessel RFID to the circuitry for bi-directional communications between the vessel RFID and the circuitry.

43. A communications method in accordance with claim 40 and further comprising reading identification information from the fluid dispenser conduit RFID from the vessel.

44. A communications method in accordance with claim 40 and further comprising reading, with the circuitry, identification information from the fluid dispenser conduit RFID, and communicating, from the vessel RFID to the fuel pump RFID interrogator, the identification information from the fluid dispenser conduit RFID.

45. A communications system for communications between a vehicle and a fluid management system, the vehicle having a fluid entry port, the fluid management system including a fluid pump, a fluid dispenser conduit including a nozzle in fluid communication with the fluid pump, an RFID interrogator in communication with the fluid pump to control operation of the fluid pump, and an antenna coupled to the RFID interrogator and supported proximate the fluid pump, the communications method comprising:

means for determining whether the nozzle is in the fluid entry port; and means supported from the vehicle, and coupled to the determining means, for communicating to the fluid pump interrogator to identify the vehicle to the fluid pump interrogator, and to communicate whether the nozzle is in the fluid entry port.

46. A communications system in accordance with claim 45 wherein the determining means comprises an identification device configured to be supported from the nozzle.

* * * * *